United States Patent [19]

DiIenno

[11] 4,420,104

[45] Dec. 13, 1983

[54] UNIVERSAL CARRYING CASE

[76] Inventor: Steven J. DiIenno, 6040 Lindbergh Blvd., Philadelphia, Pa. 19103

[21] Appl. No.: 324,644

[22] Filed: Nov. 25, 1981

[51] Int. Cl.[3] ..... A45F 5/00

[52] U.S. Cl. ..... 224/250; 224/253; 224/901

[58] Field of Search ..... 224/163, 250, 253, 901, 224/269, 904, 914; 24/204, 31 V

[56] References Cited

U.S. PATENT DOCUMENTS

| | | | |
|---|---|---|---|
| 417,220 | 12/1889 | Bell | 224/250 X |
| 702,398 | 6/1902 | Bowyer | 224/250 |
| 2,096,376 | 10/1937 | Lauppe | 224/253 X |
| 2,524,639 | 10/1950 | Saunders | 224/250 X |
| 3,057,354 | 10/1962 | Roberts et al. | 128/289 |
| 3,200,414 | 8/1965 | Sternberg | 2/232 |
| 3,372,438 | 3/1968 | Rinecker | 24/16 |
| 3,383,738 | 5/1968 | Fox et al. | 24/81 |
| 3,467,111 | 9/1969 | Benson | 132/46 |
| 3,841,648 | 9/1974 | Meyer | 280/11.37 A |
| 3,900,617 | 8/1975 | Grenoble | 427/387 |
| 3,923,222 | 12/1975 | Groves | 224/250 X |
| 3,977,582 | 8/1976 | McMahon | 224/901 X |
| 3,990,617 | 11/1976 | Carter | 224/5 H |
| 4,057,757 | 11/1977 | Darden, Jr. | 224/901 X |
| 4,119,249 | 10/1978 | Hanson | 224/26 R |
| 4,174,793 | 11/1979 | Wisowaty | 224/240 |
| 4,234,116 | 11/1980 | Myers | 224/250 |
| 4,264,024 | 4/1981 | Harris, Jr. | 224/250 |
| 4,303,239 | 12/1981 | Walsh, Jr. | 224/253 X |
| 4,337,883 | 7/1982 | Pate | 224/253 X |

*Primary Examiner*—William Price
*Assistant Examiner*—Gary E. Elkins
*Attorney, Agent, or Firm*—Benasutti and Murray

[57] ABSTRACT

A light weight and convenient universal article case or carrier for transporting mobile communication equipment, or the like, on one's person is disclosed. The case is formed by initially fabricating two flexible tape strap lengths into a T-shaped member. Proximal and distal ends of vertical and horizontal components of the T-shaped member selectively carry complementary hook and pile fastening surfaces which enable the ends to interface with one another to provide an interconnection and which thereby results in the universal article case disclosed herein.

The interconnection formed by a novel placement of the hook and pile fastening surfaces of the proximal and distal ends of the T-member resists separation by shearing forces at their respective planes of engagement, but nevertheless, can be easily separated in response to a peeling force normal to the plane of engagement.

14 Claims, 6 Drawing Figures

UNIVERSAL CARRYING CASE

BACKGROUND OF THE INVENTION

1. Field of the Invention

The present invention relates to a field of carrying cases, and in particular relates to a field of carrying cases that utilize complementary, overlapping, gripper type fasteners.

2. Description of the Prior Art

Presently known carrying cases that are utilized for carrying equipment on one's person suffer from serious shortcomings among which are initial expense, heavy weight, large bulk, lack of flexibility, need for a shoulder strap, breakdown of case stitching and expense of repair thereof. These shortcomings are especially evident to police and security personnel, who carry mobile radio communication equipment in such carrying cases while walking an assigned territory. Not only is mobile communication equipment heavy (3 to 5 pounds), but the carrying case, which is generally made of $\frac{1}{4}$–$\frac{3}{8}$ inch thick leather, is also heavy. The combination of heavily encased mobile communication equipment, in combination with a gun holster and bullet belt, makes for a burdensome combination to transport during a workday.

The heavy communication equipment which is carried day-in and day-out by personnel, such as police officers, places a heavy stress on stitching which is utilized in holding prior art case component parts together. Eventually, such stress causes the stitching to rupture thereby requiring repair. In today's inflationary economy, it is likely that if a person skilled in leather repair can be found, cost might be prohibitive so that purchase of a new case is warranted. The expense of repair is also applicable with respect to metal buttons that are utilized in a covering flap in presently known carrying cases. Such buttons tend to eventually become loosened within the leather case so that repair is required. As with respect to stitching, button repair and replacement is expensive, a nuisance and annoying.

Other shortcomings of present day carrying cases for use with, for example, heavy communication equipment are clearly evident. Thus, large bulk and lack of flexibility of modern day carrying cases because of their thick and heavy construction make storage thereof unfeasible when not in use. In other words, inability to roll-up present day carrying case for storage purposes further detracts from its utility in the present day work world.

A prior art patent that bears on the instant invention is U.S. Pat. No. 3,900,617. This patent is particularly pertinent in view of its discussion of the shortcomings of present-day leather cases, which essentially is in agreement with shortcomings thereof discussed above. However, the prior art patentee's arrangement for overcoming the prior art radically departs for Applicant's solution. Thus, the patentee has devised a belt radio clip made of 20 gauge stainless steel and which is adapted to carry two-way communication equipment having a different lower dimension from its upper dimension. This prior art invention is not suitable for carrying heavy objects whose external dimensions are constant, nor can the patentee adapt his carrying case to all sizes and shapes which is a notable characteristic of the present invention.

Other prior art which has been discovered in a prior art search but are not deemed to be significantly pertinent are U.S. Pat. Nos. 3,057,354; 3,200,414; 3,383,738; 3,467,111; 3,841,648; 4,119,249 and 4,174,793.

SUMMARY OF THE INVENTION

The present universal carrying case invention, which is initially fabricated into a flexible T-shaped member made of complementary gripper tape fastening materials, is formed into a receiving unit for transporting an oblong, substantially heavy, object on one's person. The T-shaped member is shaped into a carrying case apparatus by uniquely locating complementary hook and pile fastening materials on certain surfaces of three free ends of the T member. Thereafter, the three free ends are brought together by looping vertical and horizontal components of the T-shaped member so that they converge at a common point. An interconnection is formed at the common point by interfacing the complementary hook and pile fastening material fastening surfaces in such a manner that the free ends become attached to one another to form a plane of engagement. Upon attachment by interfacing of the hook and pile surfaces, the interconnection formed thereby resists separation by forces parallel to the plane of engagement. However, the three free ends of the T-shaped member which form the interconnection may be separated from one another by a peeling force perpendicular to the plane of engagement. Thus, the universal carrying case as taught by this invention provides for a simple T-shaped construction wherein its free ends can be interconnected to firmly resist separation during normal usage, but nevertheless may be easily separated upon application of force in the proper direction.

The universal carrying case of the present invention also provides a simple belt loop on the underside where the vertical and horizontal members of the T-shaped member intersect. Therefore, when the horizontal and vertical members are looped and joined together to form the interconnection, the carrier merely inserts his belt into the underside loop so that the carrying case in which mobile communications equipment, or the like, is inserted may be readily transported on one's person.

The simple yet novel carrying case of this invention satisfies a real need while overcoming many of the shortcomings of existing prior known personnel carrying cases. Thus, the tape material utilized to provide the vertical-horizontal loop arrangement in combination with its complementary, overlapping, gripper type interconnecting arrangement forms a universal carrying case which is light of weight, flexible, lacking bulk, relatively economical to fabricate and long wearing. This type of carrying case satisfies a need in particular among those who are guardians of public safety and who carry heavy communication in equipment on their person.

Therefore, it is an object of this invention to provide a new and improved universal carrying case.

It is a further object of this invention to provide a universal carrying case that is simple in design and can be manufactured at low cost.

It is another object of this invention to provide a universal carrying case that is readily adaptable to different size objects which are to be carried.

It is an additional object of this invention that satisfies a need for a universal carrying case which is light, flexible with minimum bulk, and relatively long wearing.

BRIEF DESCRIPTION OF THE DRAWINGS

Referring now to the drawing there is depicted several views of the present invention for aiding in a complete understanding thereof wherein.

DESCRIPTION OF THE PREFERRED EMBODIMENTS

Figure 1:
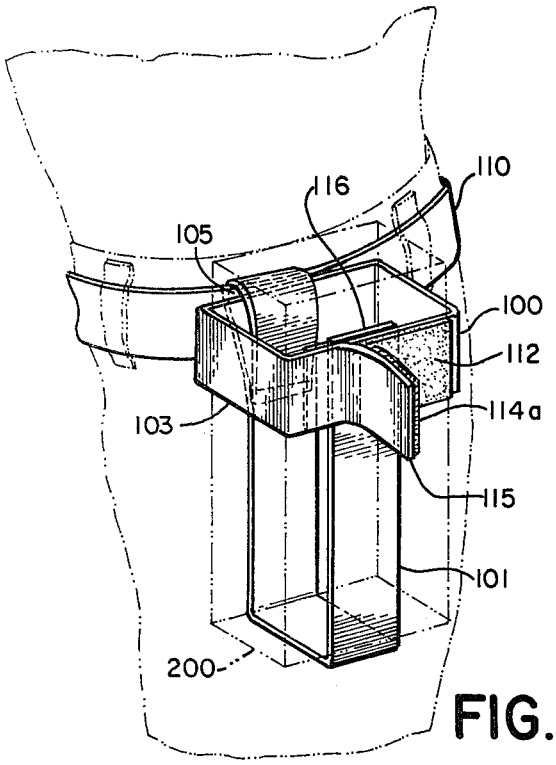
FIG. 1, is a view showing the universal carrying case attached to a carrier's belt and further showing how the case is assembled with respect to an object being carried.

Referring to FIG. 1 in greater detail, the universal carrying case 100 of this invention is shown attached to the belt 110 of a carrier via a loop 105, which is located on the case. A two-way radio 200 (in phantom) or the like, which is often carried on the respective person of law enforcement officials, guards and fire officials is located within the carrying case 100. The case 100 is fabricated into a tape assembly having complementary, overlapping, gripper type fasteners of hook and pile material which is sold under the trademark "Velcro". As will be explained in greater detail hereinafter, the "Velcro" hook and pile surfaces are utilized because of their ability to resist separation by shearing forces parallel to the plane of engagement between hook and pile material strips that interface with one another, yet can be easily separated in response to a peeling force that is applied normal to one end of the same plane of engagement.

Figure 2:
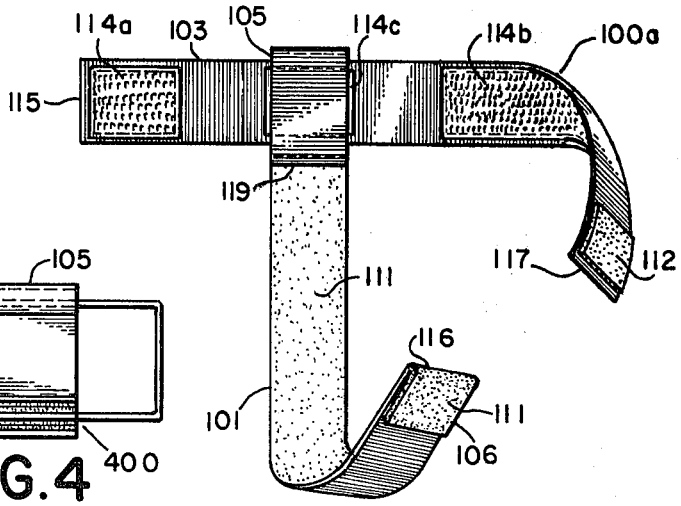
FIG. 2 is a plan view of the universal carrying case which resembles a T configuration in an unassembled form.

Referring now to the plan view of FIG. 2 wherein the universal carrying case 100 is depicted in its basic unassembled T-shaped configuration 100*a*, it can be readily appreciated that the configuration disclosed herein is composed of essentially two components comprising a vertical component or tape strip 101 and a horizontal component or tape strip 103. The vertical component 101 of the T-shaped member 100*a* has an upper surface composed essentially of a plurality of pile elements 111. However, it should be noted that the underside of the vertical component 101 is also covered with a short section 106 of the same plurality of piled elements 11 as exists on its upper surface. The section 106 of the plurality of pile elements may be formed on the underside by various ways, but in the preferred embodiment, this section is obtained by simply causing distal free end 116 of the vertical component 101 to be folded back on itself and attached thereat. It will be apparent to those skilled in the art that the section 106 might also be separately attached by various means such as attaching by sewing or other means. The formation of the plurality of pile elements 111 on the short section 106 of the underside of vertical component 101 is significant in the formation of the universal carrying case of this invention, as will be discussed in greater detail in a later paragraph.

Figure 3:
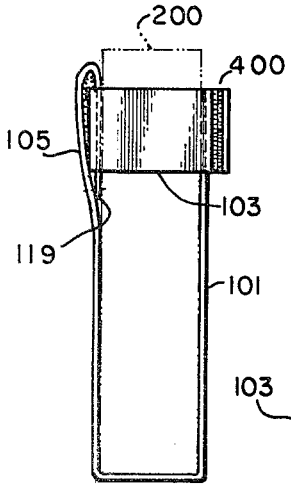
FIG. 3 is a side view of the universal carrying case with respect to an object being carried.
Figure 4:
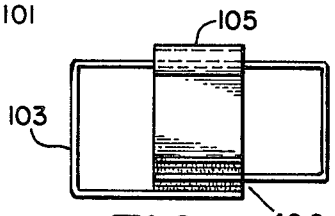
FIG. 4 is a top view of FIG. 3.

Located at the proximal end 119 of the vertical component 101 of the T-shaped carrying case 100 is a loop 105 which can also be readily seen in FIGS. 1, 3 and 4. The loop 105 is provided in order to allow a carrier's belt 110 (FIG. 1) to be threaded therethrough for transporting the case 100 and two-way radio 200 on one's person. The loop 105 also permits the horizontal component 103 of the case 100 to be threaded therethrough as will be discussed in detail hereinafter. It should be noted hereat that again for ease of manufacture, the loop 105 can be easily formed by simply folding the distal end 119 forward upon itself so that the pile surface 111 is on both inside surfaces within the loop 105. The proximal end 119 is attached after the loop 105 has been formed by sewing or similiar means. Again it should be observed that other techniques are available to those skilled in the art to make loop 105.

The horizontal component 103 of the T-member 100*a* incorporates a complementary hook surface 114*a*, 114*b* at its distal free end 115 and proximal free end 117, respectively, in an upward facing direction. A hook surface 114*c* may also be provided on the horizontal component 103. However, for ease of manufacture the entire upward facing surface of horizontal component 103 may be made of a hook surface in order to provide a complementary surface to the pile surface within loop 105. This arrangement enables an intersection of the vertical 101 and horizontal component 103 to become attached so that they cannot slide with respect to one another. On the underside of the horizontal component 103 at its proximal end 117, a complementary pile surface 112 is formed for a short distance. The reason for the positioning of the pile surface on the right hand end of the horizontal component 103 will become significant when the T-shaped carrying case is fully assembled as will be discussed hereinafter.

Referring again to FIG. 1, there is depicted the universal carrying case 100 of this invention in partial assembly in which a radio 200 is being carried on the belt 110 of a carrier. The first step in the assembly requires that the vertical component 101 and the right hand half of the horizontal component 103 of the T-member 100*a* be looped back upon each other so that the distal end 116 and the proximal end 117 be brought in juxtaposition with one another. By overlapping and thereafter interfacing the pile surface 111 formed on the section 106 (underside of vertical component 101) with the hook surface 114*b* on the upper surface near proximal end 117, a union between these two members is formed as shown in FIG. 1. In other words, when the complementary hook surface 114*b* is brought into overlapping engagement with the pile surface located on section 106 they will co-act with one another to form a union so that they will resist separation by shearing forces parallel to their plane of engagement. It should be noted that the reverse pile section 106 of the vertical component 101 is made to interface and become engaged with the hook elements 114*b* on the horizontal component 103, the pile elements 112 formed on the underside of horizontal component 103 are now facing outwardly (see FIG. 1). The reason for this will readily become apparent upon further reading.

To complete this formation of the carrying case 100, the distal end 115 is looped to become juxtaposed to the above discussed union formed with respect to pile surface 111 and hook surface 114*b*. This is graphically depicted in FIG. 1 wherein the distal end 115 is looped to become juxtaposed to the above discussed union formed with respect to pile surface 111 and hook surface 114*b*. This is graphically depicted in FIG. 1 wherein the distal end 115 is shown just prior to engaging with pile surface 112. Again, by the interfacing of the plurality of pile elements 112 with the plurality of complementary hook elements 114a an interconnection 400 will be formed as shown in FIGS. 3, 4. Therefore, by reason of the unique placement of the complementary hook and pile surfaces along the distal and proximal locations 115, 116, 117, the vertical and horizontal components 101, 103 will be joined to one another to the interconnection 400. The interconnection 400 will resist separation by shearing forces parallel to the planes of engagement, while easily separating in response to a peeling force essentially normal to the planes of engagement.

Accordingly, it can be readily appreciated that by joining the three free ends 115, 116 and 117 of the vertical and horizontal components 101, 103, respectively, a universal carrying case 100 is provided for transporting a rectangular object such as a two-way communications radio 200 on one's person. The universal carrying case 100 is simple in design, light weight, readily fabricated and yet provides a strong support for a heavy device, such as a two-way radio 200, which may weight as much as ten pounds. It should be further noted and appreciated that the universal carrying case of the present invention is readily adaptable for various sized objects which are to be carried on one's person. This results from the fact that the horizontal and vertical components 101, 103, respectively, can be readily adapted to the size of the object being transported and carried on one's person. In other words, depending upon the size of the object to be transported and carried, the horizontal and vertical components are merely tightened or enlarged as the case may be. Thus, by way of example, the universal carrying case 100 as taught by this invention can be formed with the communication equipment 200 in place after which the free ends 115, 116 and 117 (FIG. 2) are joined to form an interconnection 400. However, in an event that a smaller or slightly larger device is to be transported on one's person the free ends 115, 116 and 117 are joined to one another and are merely adapted to the new dimensions of the device being carried.

Figure 5:
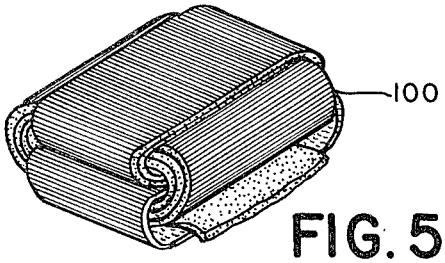
FIG. 5 is a view of the case provided by this invention in its folded-up configuration.

Referring now to FIG. 5, there is depicted the universal carrying case 100 of this invention in a folded-up configuration which is suitable for storage during non-use. In the folded configuration, the vertical and horizontal components 101, 103 are individually wrapped around each other until a small, neat, pocket-size unit is provided for storage purposes.

Figure 6:
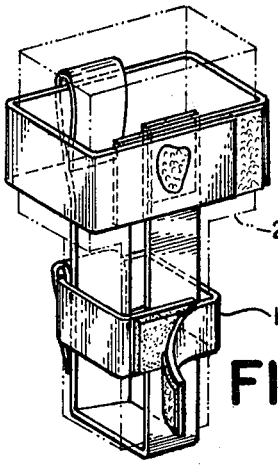
FIG. 6 is another embodiment of the invention.

Referring now to FIG. 6, another embodiment of the invention is shown wherein an additional horizontal component 103' is provided to support a multi-dimensional device 200'. In all respects the operation of this configuration is similiar to that of FIG. 1 except for the additional component 103'.

What I claim is:

1. A universal carrying case comprising:

a first flexible tape like member having a loop formed at one end thereof, a first fastening surface extending from said loop to the free end thereof, and a second complementary fastening surface secured to said first member on the surface opposite said first fastening surface;

a second flexible tape like member extending through the loop of said first member, said second tape like member having a first fastening surface extending over the entire surface thereof and a second complementary fastening surface secured thereto on the surface opposite said first fastening surface.

2. A universal carrying case according to claim 1 wherein said first and said second complementary fastening surfaces comprise respectively pile and hook surfaces.

3. A universal carrying case according to claim 1 wherein said first and said second complementary fastening surfaces comprise respectively hook and pile surfaces.

4. A universal carrying case according to claim 1 wherein said second complementary fastening surface is secured at the free end of said first member on the surface opposite said first fastening surface and at one end of said second member on the surface opposite said first fastening surface.

5. A universal carrying case according to claim 3 wherein said first and second complementary fastening surfaces comprise respectively pile and hook surfaces.

6. A universal carrying case according to claim 3 wherein said first and second complementary fastening surfaces comprise respectively and hook and pile surfaces.

7. A universal carring case comprising:

a first flexible tape like member having a loop formed at one end thereof, a first fastening surface at the free end thereof, and a second complementary fastening surface secured to said first member on the surface opposite said first fastening surface;

a second flexible tape like member extending through the loop of said first member, said second tape like member having a first fastening surface extending over the entire surface thereof and a second complementary fastening surface secured thereto on the surface opposite said first fastening surface.

8. A universal carrying case according to claim 7 wherein said first and said second complementary fastening surfaces comprise respectively pile and hook surfaces.

9. A universal carrying case according to claim 8 wherein said first and said second complementary fastening surfaces comprise respectively pile and hook surfaces.

10. A universal carrying case according to claim 7 wherein said second complementary fastening surface is secured at the free end of said first member on the surface opposite said first fastening surface and at one end of said second member on the surface opposite said first fastening surface.

11. A universal carrying case according to claim 10 wherein said first and second complementary fastening surfaces comprise respectively pile and hook surfaces.

12. A universal carrying case according to claim 10 wherein said first and second complementary fastening surfaces comprise respectively hook and pile surfaces.

13. A universal carrying case comprised essentially of complementary hook and pile surface fastening materials, said case comprising:

a first portion of one of said materials having a loop formed at one end thereof, a first fastening surface extending from said loop to the free end thereof, and a strip of the complementary fastening material secured to said first portion on the surface opposite said first fastening surface;

a second portion of one of said materials extending through the loop of said first portion, said second portion having the first fastening surface extending over the entire surface thereof and the second complementary fastening surface secured at one end thereof on the surface opposite said first fastening surface.

14. A method of making a carrying case comprising the steps of:

1. providing a tape like material having a fastening surface on one surface thereof;
2. providing a second tape like material having a complementary fastening surface thereon;
3. selecting a first length of said first tape like material and forming a loop at one end thereof;
4. securing a portion of said second, complementary material to the length of step 3 and the end opposite said loop and on the surface opposite said fastening surface;
5. selecting a second length of said first tape like material and securing a portion of said second, complementary material at one end thereof on the side opposite said first fastening surface;
6. inserting said second length through the loop of said first length.

* * * * *